US007455182B2

(12) United States Patent
Merckell

(10) Patent No.: US 7,455,182 B2
(45) Date of Patent: Nov. 25, 2008

(54) BOX WITH LID

(75) Inventor: Rudiger Merckell, Vevey (CH)

(73) Assignee: Philip Morris USA Inc., Richmond, VA (US)

( * ) Notice: Subject to any disclaimer, the term of this patent is extended or adjusted under 35 U.S.C. 154(b) by 159 days.

(21) Appl. No.: 10/479,714

(22) PCT Filed: Jun. 11, 2002

(86) PCT No.: PCT/EP02/06367

§ 371 (c)(1),
(2), (4) Date: Jun. 4, 2004

(87) PCT Pub. No.: WO02/100727

PCT Pub. Date: Dec. 19, 2002

(65) Prior Publication Data

US 2004/0232015 A1 Nov. 25, 2004

(30) Foreign Application Priority Data

Jun. 11, 2001 (DE) ..... 101 28 243

(51) Int. Cl.
*B65D 5/72* (2006.01)

(52) U.S. Cl. ..... 206/754; 206/250; 206/759; 206/817

(58) Field of Classification Search ..... 206/242, 206/259, 261, 271, 273, 265, 249–251, 751–755, 206/759–762, 817, 756, 747; 229/87.13, 229/14

See application file for complete search history.

(56) References Cited

U.S. PATENT DOCUMENTS 1,007,113 A * 10/1911 Kazian ..... 206/251
1,029,096 A * 6/1912 Wolf ..... 206/749
1,186,624 A * 6/1916 Vanderveer ..... 206/249
1,192,707 A * 7/1916 Thornedike ..... 206/251
1,354,042 A * 9/1920 Hunziker ..... 206/259
1,666,001 A * 4/1928 Tiburce ..... 206/754
1,859,049 A * 5/1932 Poppe ..... 206/754
2,657,793 A 11/1953 Goldshine
3,353,657 A * 11/1967 Young ..... 206/755
3,765,528 A * 10/1973 Parisot ..... 206/754
4,588,081 A * 5/1986 Newsome et al. ..... 206/251

(Continued)

FOREIGN PATENT DOCUMENTS

CH 197747 5/1938

(Continued)

OTHER PUBLICATIONS

International Search Report dated Sep. 5, 2003.

*Primary Examiner*—Jacob K Ackun, Jr.
(74) *Attorney, Agent, or Firm*—Buchanan Ingersoll & Rooney PC

(57) ABSTRACT

The application relates to a flat box (10) with a bottom container part (20), a top lid (30) and with an insert (40) which serves to raise the pack contents when the box (10) is opened. The lid (30) and the container part (20) are connected to each other via the rear side walls of the box (10). The insert (40) is connected to the inside of the rear lid side wall and extends into the container part (20) so that it and the pack contents placed on the insert (40) are automatically raised when the box (10) is opened.

24 Claims, 5 Drawing Sheets

U.S. PATENT DOCUMENTS

Figure 1:
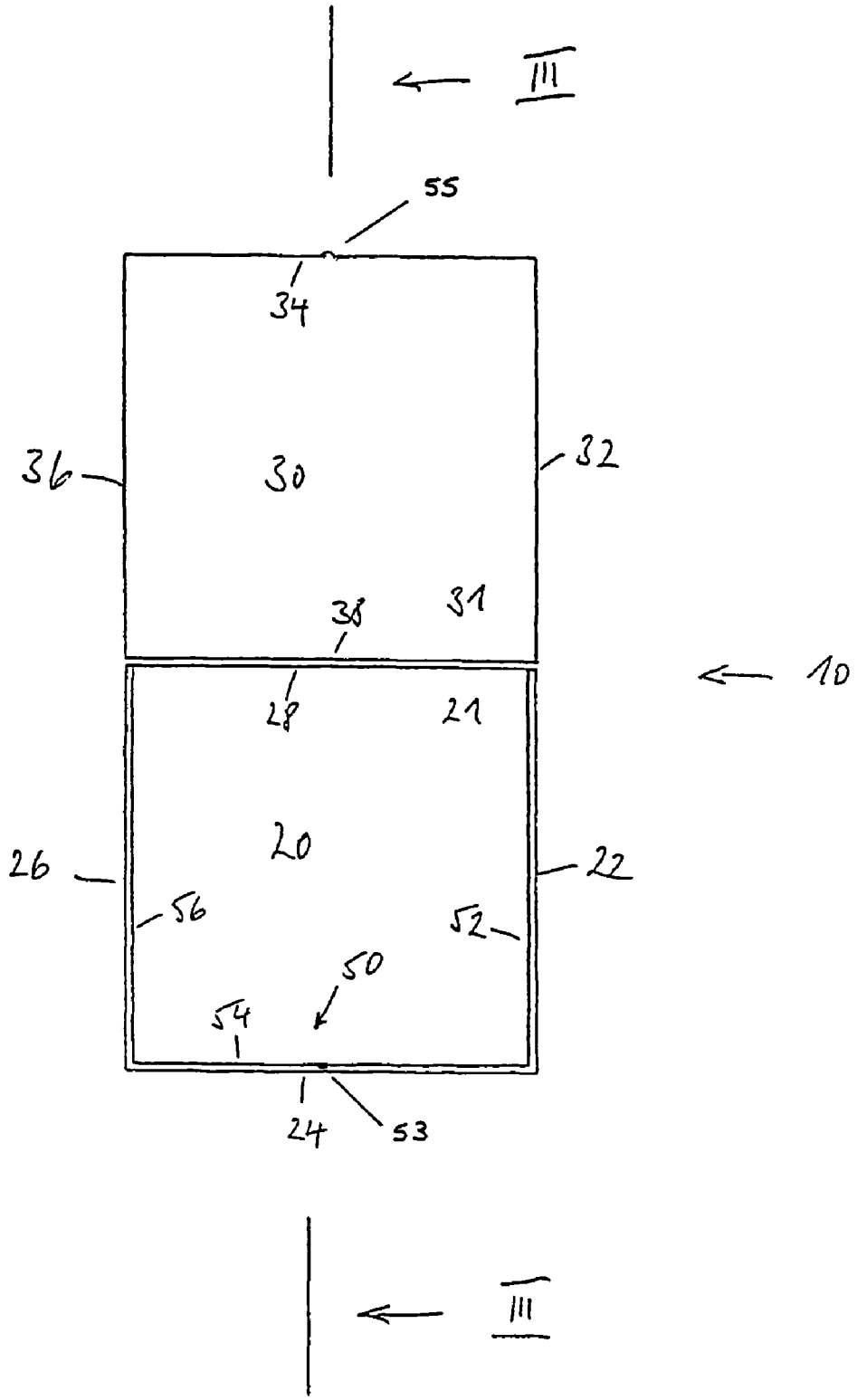

| | | | | |
|---|---|---|---|---|
| 4,607,748 | A * | 8/1986 | Focke | 206/254 |
| 4,763,779 | A | 8/1988 | Focke et al. | |
| 4,912,910 | A * | 4/1990 | Lowe et al. | 53/429 |
| 5,014,906 | A * | 5/1991 | Gero | 229/123 |
| 6,193,060 | B1 * | 2/2001 | Roberts et al. | 206/268 |

FOREIGN PATENT DOCUMENTS

| | | | |
|---|---|---|---|
| CH | 219033 | | 1/1942 |
| CH | 237898 | | 5/1945 |
| DE | 3329454 | A1 | 3/1995 |
| DE | 29619990 | U1 | 2/1997 |
| DE | 29922432 | U | 3/2000 |
| DE | 20016870.3 | | 4/2001 |
| GB | 349970 | | 6/1931 |
| GB | 582970 | A | 12/1946 |
| JP | 4-38926 | | 4/1992 |
| JP | 2000-203559 | | 7/2000 |

* cited by examiner

BOX WITH LID

RELATED APPLICATIONS

This application is a U.S. National Stage application of International Application No. PCT/EP02/06367, filed Jun 11, 2002 and published in German, and which claims priority from German Application DE 101 28 243.5, filed Jun 11, 2001.

The present application relates to a box with a bottom container part which has a base wall and front, rear and lateral container-part side walls, with a top lid which has a lid wall and front, rear and lateral lid side walls, and with an insert which is fixed in the lid and extends into the container part. When the box is opened the pack contents, which are preferably smokable articles such as cigarettes, cigars or cigarillos, are raised by the insert, so that they are easier for the user to remove.

Such a box is known for example from DE 296 19 990 U1 which describes boxes in which the insert is fixed on the inside of the lid. The insert has a Z-shaped fold which, upon opening, is pulled apart, and this straightens up the pack contents. The overall design of DE 296 19 990 U1 is therefore complicated. Furthermore, the Z-shaped fold can also lead to twisting, with the result that the box is then difficult to close again.

Such boxes are likewise known from CH 219 033, CH 197 747 and GB 349 970, in which the insert is connected on one side to the inside of the rear lid side wall and on the other side to the base wall and/or the front container-part side wall. As the insert is connected both to the lid and to the container part, it must be elastic in order to be able to compensate the tension created by the opening movement. Due to this tension, these boxes also display the tendency that the lid closes again more or less automatically as soon as it is released. These boxes must therefore be handled as a rule with both hands, the box being opened with one hand and the pack contents, such as for example a cigarette, removed with the other.

A flat box with cigarettes wrapped in an inner liner is known from U.S. Pat. No. 4,763,779 (or DE 33 29 454 A1). According to FIG. 6 of U.S. Pat. No. 4,763,779, the pack contents can be raised by pulling on the inner liner. The cigarettes are therefore not raised automatically upon opening, but manually, and the user in any case needs both hands, as otherwise the pack contents cannot be removed from the pack.

Finally, FLIP-TOP™ boxes with a container part and lid, which do not however have an insert, are known from CH 237 898.

The object of the present invention is therefore to make available a box of the above-described type, which is however of simpler design.

In order to achieve this object, the container and the lid are hinge-connected to each other via the rear container-part side wall and the rear lid side wall, and the insert is connected to the inside of the rear lid side wall, but not to the container part, e.g. its base wall and/or front container-part side wall. This firstly has the advantage that the box can be produced with considerably less material and quite simply. Furthermore, handling is also simpler as twisting cannot occur when opening and closing the box.

The insert can comprise one or more parallel narrow strips. However, the shape of the insert is preferably adapted to the base wall of the box, with the result that, when the box is closed, the insert extends up to near the front container-part side wall and essentially over the entire base wall. It is hereby advantageously achieved that the entire pack contents, which are to be raised when the box is opened, rest on the insert.

The insert can be divided into two areas, namely a larger base area and a smaller side-wall area, which are separated from each other via a fold or notch line. When the box is closed, the base area of the insert rests on the base wall of the container part and extends partially or preferably almost completely over this base wall. The insert is connected to the inside of the rear lid side wall via the smaller side-wall area. When the box is closed, the smaller side-wall area of the insert therefore extends parallel to the rear lid side wall and rear container-part side wall, and the fold or notch line rests essentially against the line between the rear container-part side wall and the container-part base wall. When the box is opened, as the rear lid side wall moves, the side-wall area connected to it and thus also the base area of the insert are correspondingly also pulled along, the top edge of the side-wall area of the insert being rotated by 180° . The fold or notch line is raised by the height of the side area of the insert. Since the pack contents are resting on the insert, upon opening they are raised together with the insert. In the opened position, the side area of the insert therefore extends up to the fold or notch line essentially parallel to the rear lid side wall. At the fold or notch line, the rear base area of the insert is folded by an angle of approx. 95 to 125° , so that the insert then runs diagonally downwards and rests on the base wall of the container part.

The side-wall area is fixed to the rear lid side wall such that the sum of the height of the side-wall area and the height of the rear lid side wall not covered by the side-wall area matches the height of the box or is slightly smaller. In this way, it is achieved that the fold or notch line in the closed box rests to the greatest possible extent precisely against the line between the rear container-part side wall and the container-part base wall. Therefore there is neither a compression of the side area nor a reduction of the inside of the box due to the base area, not resting directly on the base wall, of the insert. The height of the side-wall area must therefore be at least slightly smaller than the overall height of the box, as otherwise a compression of the side area of the insert would occur when the box is closed. As a rule, the height of the side-wall area is approx. 80 to 90% of the height of the box. In this way, on the one hand a sufficient surface area is made available for connecting the side-wall area to the inside of the rear lid side wall, and on the other hand a relatively pronounced raising of the inside of the box is achieved.

The hinged connection of the rear lid side wall to the rear container-part side wall is preferably in the middle of the rear wall of the box, this means that the height of the rear container-part side wall is equal to the height of the rear lid side wall. The height of the two side walls can also be different. However, the height of the rear container-part side wall should be at least approx. 0.3 cm or a fifth of the height of the rear lid side wall, as otherwise the effect of the raising of the pack contents is no longer achieved to a sufficient extent.

In the container part, the box can have a collar which serves to stabilize the box and also to improve storage of the pack contents. In contrast to customary boxes, the collar is preferably provided only on the inside of the front and left-hand and right-hand container-part side wall. The collar therefore preferably has front and lateral collar side walls.

The dimensions of the collar are preferably such that it extends as far as the lid wall when the box is closed, i.e. the collar preferably projects over the container-part side walls by the height of the lid side walls. This leads to an optimal stabilization of the box in the closed and in the opened position and also to a good securing of the pack contents in the box.

The collar can also have, positioned on the inside of the rear container-part side wall, a rear collar side wall. If this is present, it is if at all possible only as high as the rear container-part side wall or only slightly higher, as otherwise the attachment of the insert is not possible or is possible only with difficulty.

The box can also have a projection 53 on the front collar side wall and, corresponding to this, a recess 55 on the inside of the front lid side wall. Upon closing the box, the projection engages into the corresponding recess and thereby leads to a secure closure of the box. A slight pressure must be applied to open this, in order to pull the projection out of the corresponding recess, which is however possible without great effort. Self-evidently, the positions of the projection and the recess can also be swapped or they can be located on the collar and lid side walls.

According to an alternative version, a secure closure of the box can also be achieved by projections both on the collar and on the lid (at the front and/or at the sides), the projections being arranged and dimensioned such that, upon closing the box, they are led past each other and lie directly behind each other when the box is closed and thus offer a secure closure. A faint click can be heard which tells the user that the box is closed.

The front lid side wall and/or the lateral lid side walls can have recesses at their bottom edges. These recesses can be designed for example semicircular or elongated (e.g. over the entire front lid side wall or the front third of the lateral lid side walls). An easy opening of the box is effected by these recesses, as the user can insert his fingers into the recess(es) and can then flip open the lid more easily. For this purpose, the recess(es) is/are preferably located in the middle of the front lid side wall and/or in the front third of the left-hand and right-hand lid side wall.

The box according to the invention preferably contains, as pack contents, smokable articles such as for example cigarettes, cigars or cigarillos. These can be placed as such or wrapped into an inner liner, directly on the insert, as one or two groups of smokable articles.

However, they are preferably located in a charge or product-housing box. This is formed separately from a base wall, a rear and a front wall and side walls and can be located without being secured on the insert. In order to make the smoker's articles contained in the charge or product-housing box more easily accessible to the consumer, this box preferably has in the front wall a recess which extends for example over the top third or also the top half of the front wall. In this way, for example the filters of filter cigarettes or the top half of cigarettes are visible to the user after the box is opened and easily accessible. In the middle of the product-housing box, a wall or web can be provided by which the inside is divided into two separate compartments. Two advantages are hereby achieved. Firstly, the smokable articles contained in the product-housing box are kept more or less vertical by the wall or the web and can therefore still be easily removed even when the box is more or less completely empty, which is advantageous in particular in the case of boxes with a rectangular or square outline. In addition, the front wall of the product-housing box is supported by the wall or the web, so that a more or less pronounced indentation of the front wall, in particular when the box is largely empty, is avoided.

In order to prevent the utility box falling out of the cigarette box after opening, it can however also be glued via a flap to the inside of the front collar side wall or, in the absence of this, to the inside of the front container-part side wall.

The boxes according to the invention or their components lid, container part, insert and optionally collar and/or utility box can be made of any materials, but all parts are preferably made of the same materials and preferably of paper, paperboard or cardboard, but also of plastic or wood.

The dimensions of the boxes according to the invention are customarily such that approximately 20 to 30 cigarettes can be contained in the boxes. The side walls are therefore approximately 7 to 10, preferably 8 to 9 cm long. The overall height of the box is approximately 1.2 to 3 cm (corresponding to 2 to 3 layers of cigarettes), the height of the container-part and lid side walls is 0.3 to 2.7 cm, preferably 0.6 to 1.5 cm, and the ratio of side-wall length to height is therefore 33:1 to 2.5:1, preferably 15:1 to 6:1. The basic outline of the box is customarily rectangular. The container-part and lid side walls have as a rule the same length. The collar side walls are slightly shorter, so that they rest exactly against the inside of the container and lid side walls.

In order to make the boxes, the lid and container part can be folded for example from a single pre-cut sheet of paper or cardboard. For boxes made of wood, the container-part and lid side walls can be prefabricated and then glued or screwed together. Plastic boxes can be produced for example by injection moulding. The hinged connection between the lid and the container part can be achieved by making both parts either from a paper or cardboard pre-cut sheet which has a folding or rotating axis between the rear lid side wall and the rear container-part side wall. If the lid and the container part are two separate parts, they can be connected together for example via an adhesive tape or hinge. If the separate box parts are made of paper or cardboard, it is preferred that the entire outside of the box and thus all outer sides of the lid and of the container part are covered with a thin paper which then simultaneously also ensures the connection of the lid and the container part. Optionally, the collar parts are then glued or pushed into the boxes and also the insert is secured (e.g. glued) to the inside of the rear lid side wall. The product-housing box is made separately e.g. from a pre-cut sheet, filled optionally directly with the product contents and placed on the insert and optionally glued to the inside of the front collar side wall or, in its absence, to the inside of the front container-part side wall.

An embodiment of the invention is represented in the drawing and explained in detail in the following.

Figure 2:
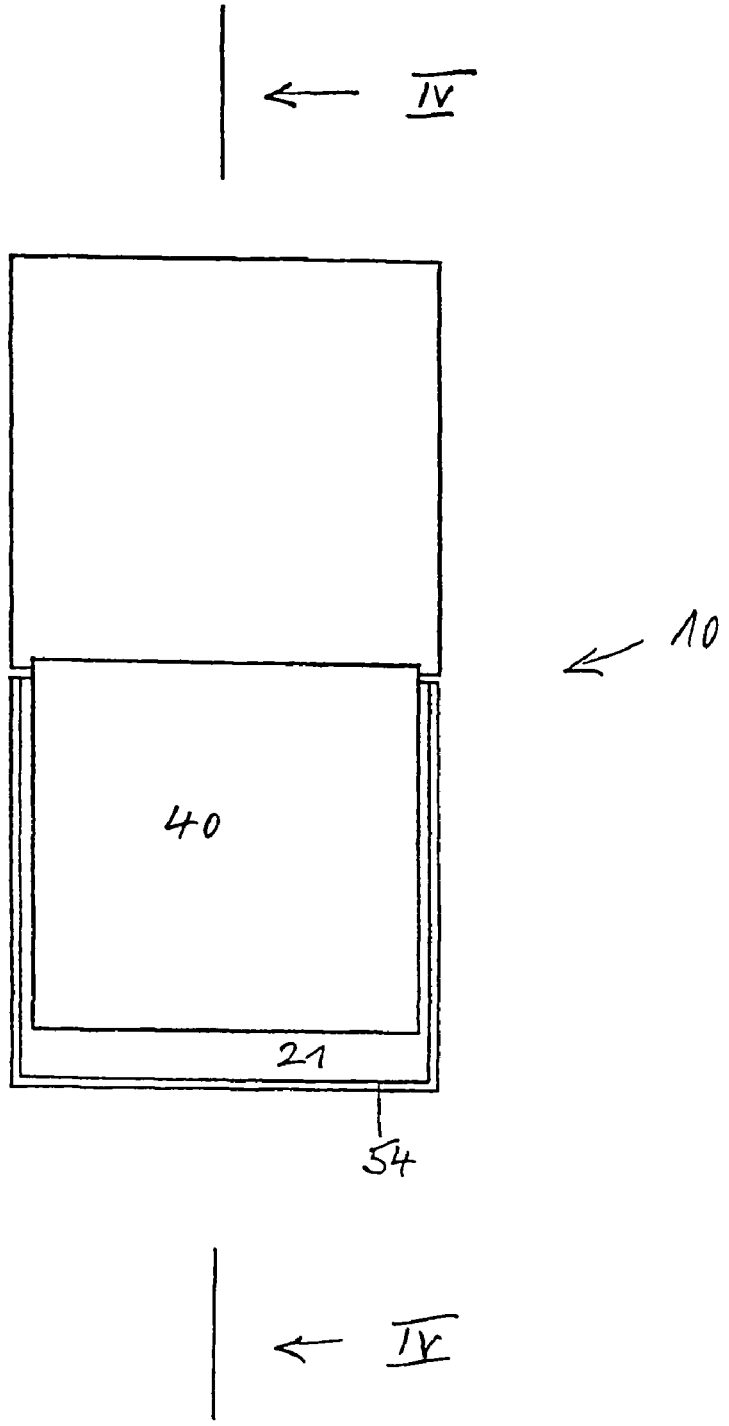
Figure 3:
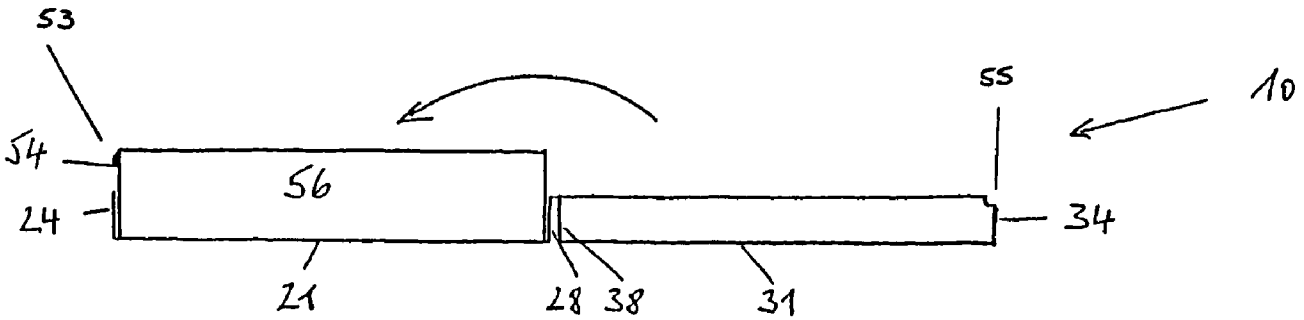
Figure 4:
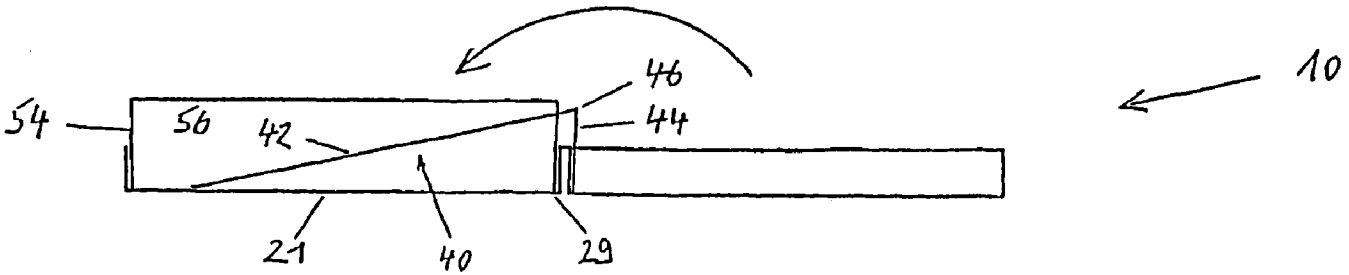
Figure 5:
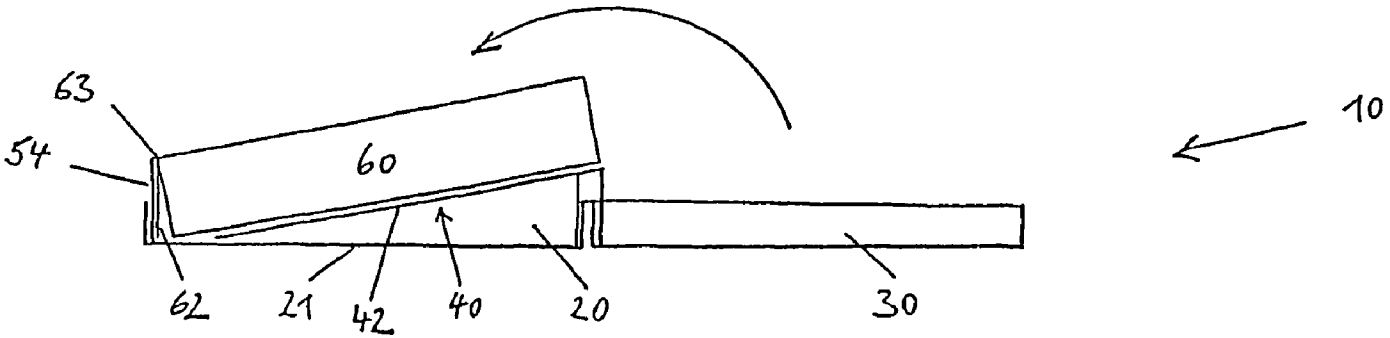
Figure 6:
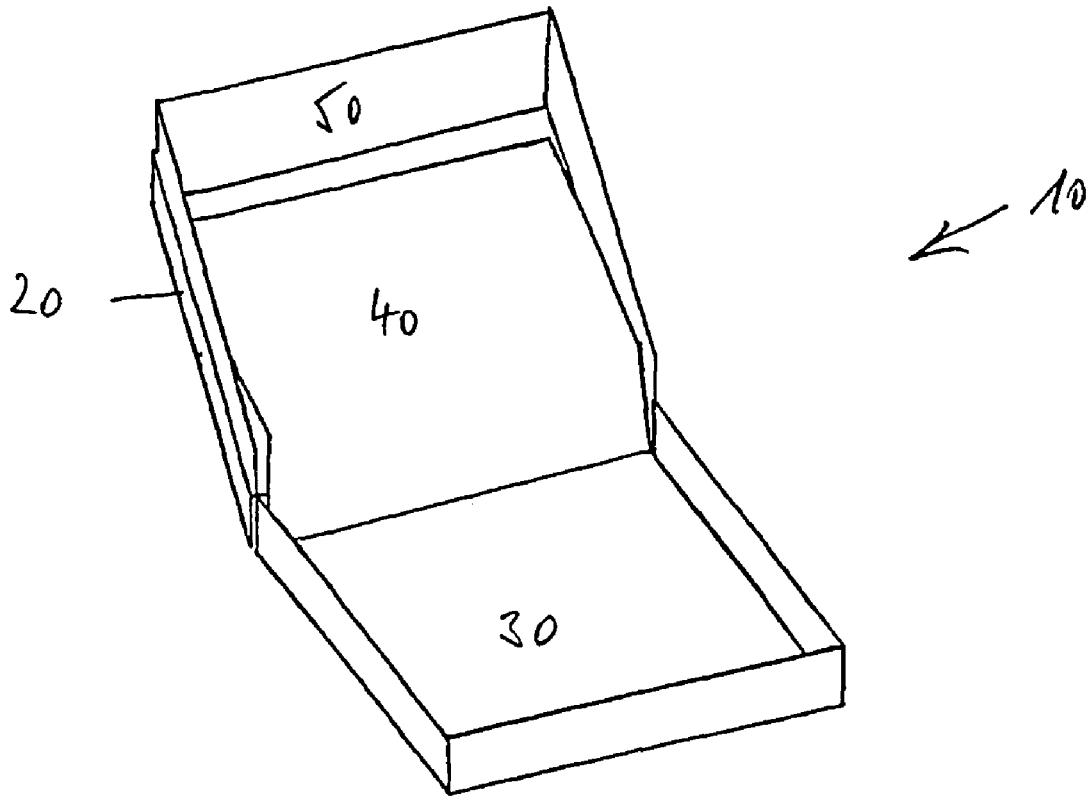
Figure 7:
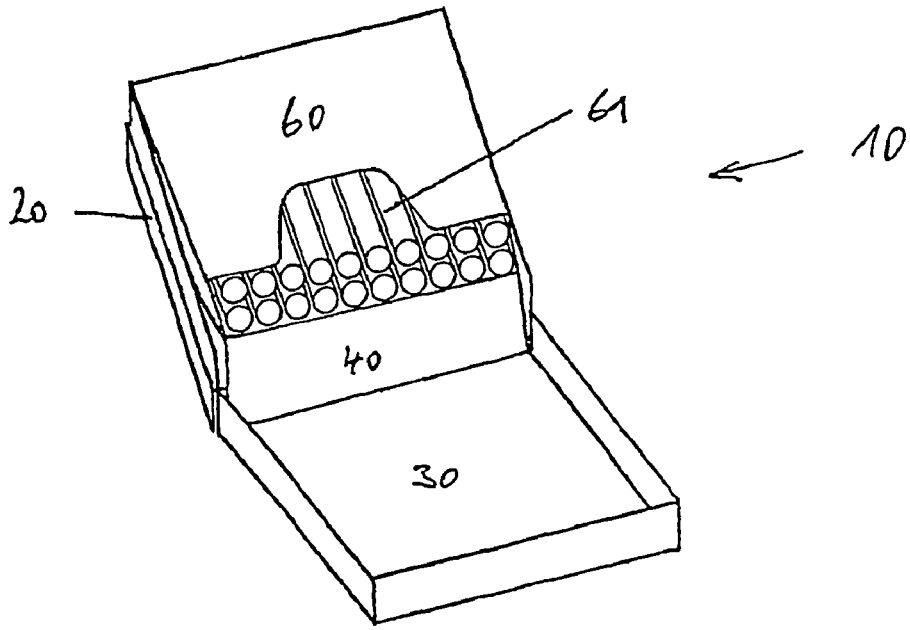

There are shown in:

FIG. 1 a view from above of a box with container part and lid,

FIG. 2 the box of FIG. 1 together with an insert,

FIG. 3 a cross-section of the box of FIG. 1 along the line III-III,

FIG. 4 a cross-section of the box of FIG. 2 along the line IV-IV,

FIG. 5 a cross-section of a box according to FIG. 4, but additionally with a product-housing box, FIG. 6 a view at a angle from above of an opened box without a product-housing box and FIG. 7 a view of the box of FIG. 6, but with product-housing box.

FIG. 1 shows a box 10 with a container part 20 and its front 24, rear 28, right-hand 22 and left-hand 26 container-part side walls and also with a lid 30 and its front 34, rear 38, right-hand 32 and left-hand 36 lid side walls. A collar 50 can also be seen with front 54, right-hand 52 and left-hand 56 collar side wall and also a base wall 21 and a lid wall 31.

The box 10 of FIG. 2 essentially corresponds to that of FIG. 1. However, the box 10 additionally has an insert 40. As FIG. 2 shows, the insert 40 does not extend completely over the base wall 21 when the box is opened. If the box is closed, however, the insert 40 is simultaneously pushed in the direction of and up to the front collar side wall 54 and then extends completely over the base wall 21.

FIG. 3 shows a cross-section through the box 10 of FIG. 1 along the section line III-III. It can be seen that the height of the container-part and lid side walls is the same. However, the height of the collar side walls is twice as high as the container-part and lid side walls. If the box 10 of FIG. 3 is closed, indicated by an arrow in FIG. 3, the collar side walls will extend as far as the lid wall 31.

FIG. 4 then shows a cross-section through the box 10 of FIG. 2 along the section line IV-IV. It can be seen in particular that the insert 40 consists of the base area 42 and the side-wall area 44. The side-wall area is partially connected to the inside of the rear lid side wall 38. The height of the side-wall area 44 of the insert 40 is slightly smaller than the height of the box or the height of the left-hand collar side wall 56. Thereby, on closing the box, indicated again in FIG. 4 as in FIG. 3 by an arrow, the folding line 46 between the base area 42 and the side-wall area 44 of the insert 40 will rest exactly against the line 29 between the base wall 21 and the rear container-part side wall 28. The base area 42 will thus also come to lie directly on the base wall 21, so that all of the inside of the box is available for the pack contents and there is no unnecessary loss of space. It can also be seen that during the closing movement, the base area 42 of the insert 40 will move in the direction of and as far as the front collar side wall 54.

The box 10 of FIG. 5 corresponds to the box 10 of FIG. 4, but a product-housing box 60 is also shown in which for example cigarettes are located. This product-housing box 60 rests on the base area 42 of the insert 40 without being connected to this. Located against the base wall of the product-housing box 60 is a flap 62 which rests against the inside of the front collar side wall 54 and is glued to this. The flap 62 is connected to the product-housing box 60 only at the top edge 63. To this end, for example, a part of the base wall of the product-housing box 60 can be cut out and form the flap 62. The effect of this flap is therefore that the product-housing box 60 is connected to the box 10 via the front collar side wall 54, but on the other hand is able to move freely within the container part 20. Upon closing the box 10, the base area 42 of the insert 40 will therefore again travel in the direction of the front collar side wall 54 and simultaneously move downwards to the base wall 21. The product-housing box 60 is introduced into the container part 20 by this movement. On the other hand, as a result of the reversed movement when opening the box, the product-housing box 60 is raised in the desired way out of the container part 20, this occurring automatically through the opening of the box. During the opening movement, the insert 40 is automatically pushed forward with the lid 30 and pulled upwards and the product-housing box 60 is thus raised.

FIG. 6 shows a box 10 according to the invention in the opened position. The box 10 of FIG. 6 corresponds essentially to the box 10 of FIG. 2, but from a different perspective. The container part 20, the lid 30, the insert 40 and the collar 50 can again be seen.

FIG. 7 shows the box 10 of FIG. 6, but now also with a product-housing box 60, which rests on the insert 40. Cigarettes 61 are contained in the product-housing box 60.

In a further version of the box according to the invention, it can have a recess in the base wall of the container part, for example a circular recess near to the rear container-part side wall. Through the recess, the user can exert pressure on the insert and thereby support the automatic raising process. For this it is in principle not necessary that the insert be connected to the inside of the rear container-part side wall, rather the insert can lie on the container-part base wall without being connected to the box and be adapted to it in terms of size. The base wall can also be completely omitted so that the group of cigarettes wrapped into an inner liner can be raised over the recess of the base wall by the pressure of the finger.

The invention claimed is:

1. Box with a bottom container part which has a bottom wall and front, rear, right-hand and left-hand container-part side walls, with a top lid, which has a lid wall and a front, rear, right-hand and left-hand lid side walls, and with an insert fixed in the lid, which extends into the container part and serves to raise a product or a product housing when the box is opened, the insert having a base area and a side-wall area, which are separated from each other by a fold line, the length of the side walls being a multiple of their height and the container part and the lid being hinge-connected to each other along the rear side walls, wherein the container part and the lid are hinge-connected to each other via the rear container-part side wall and the rear lid side wall and the insert is connected to the inside of the rear lid side wall, but not to the container part, the product or the product housing placed on the insert; and wherein when the box is closed, the base area of the insert extends to near the front container-part side wall and essentially extends over the entire bottom wall, the side-wall area of the insert extends parallel to the rear lid side wall and the rear container-part side wall, and the fold line rests essentially against a line between the rear container-part side wall and the bottom wall.

2. Box according to claim 1, wherein the hinge-connection between the rear container-part side wall and the rear lid side wall is in a middle of the rear wall of the box, such that the height of the rear container-part side wall is equal to the height of the rear lid side wall.

3. Box according to claim 1, further comprising a product-housing box.

4. Box according to claim 3, wherein the product-housing box has a recess in its top side.

5. Box according to claim 3, wherein the product-housing box is connected to the inside of a front collar side wall or the inside of the front container-part side wall.

6. Box according to claim 1, containing smokable articles.

7. Box according to claim 6, wherein the smokable articles are wrapped into an inner liner.

8. Box according to claim 4, wherein the product-housing box is connected to the inside of a front collar side wall or the inside of the front container-part side wall.

9. Box according to claim 3, wherein an entirety of the product-box housing rests on the insert.

10. Box according to claim 1, wherein the insert is made of paper, paperboard, cardboard, plastic or wood.

11. Box according to claim 1, wherein the insert is comprised of one or more parallel strips.

12. Box according to claim 1, wherein when the box is in an opened position, the side area of the insert is essentially parallel to the rear lid side wall.

13. Box with a bottom container part which has a bottom wall and front, rear, right-hand and left-hand container-part side walls, with a top lid, which has a lid wall and a front, rear, right-hand and left-hand lid side walls, and with an insert fixed in the lid, which extends into the container part and serves to raise a product or a product housing when the box is opened, the insert having a base area and a side-wall area, which are separated from each other by a fold line, the length of the side walls being a multiple of their height and the container part and the lid being hinge-connected to each other along the rear side walls, wherein the container part and the lid are hinge-connected to each other via the rear container-part side wall and the rear lid side wall and the insert is connected to the inside of the rear lid side wall, but not to the container part, or the product or the product housing placed on the insert;

a collar with front and right-hand and left-hand collar side walls is attached to the inside of the front, left-hand and right-hand container-part side walls; and wherein when the box is closed, the base area of the insert extends to near the front container-part side wall and essentially extends over the entire bottom wall, the side-wall area of the insert extends parallel to the rear lid side wall and the rear container-part side wall, and the fold line rests essentially against a line between the rear container-part side wall and the bottom wall.

14. Box according to claim 13, wherein the collar projects over the front, left-hand and right-hand container-part side walls.

15. Box according to claim 14, wherein a projection is provided on the front collar side wall and a corresponding recess is provided on the inside of the front lid side wall.

16. Box according to claim 13, wherein the collar projects over the front, left-hand and right-hand container-part side walls by the height of the front, left-hand and right-hand lid side walls.

17. Box according to claim 13, further comprising a product-housing box.

18. Box according to claim 17, wherein the product-housing box has a recess in its top side.

19. Box according to claim 17, wherein the product-housing box is connected to the inside of the front collar side wall or the inside of the front container-part side wall.

20. Box according to claim 19, wherein the base area is without fold lines when the box is opened.

21. Box according to claim 17, wherein an entirety of the product-box housing rests on the insert.

22. Box according to claim 13, wherein the insert is made of paper, paperboard, cardboard, plastic or wood.

23. Box according to claim 13, wherein the insert is comprised of one or more parallel strips.

24. Box according to claim 13, wherein when the box is in an opened position, the side area of the insert is essentially parallel to the rear lid side wall.

* * * * *